US005931604A

United States Patent [19]

Queen et al.

[11] Patent Number: 5,931,604

[45] Date of Patent: Aug. 3, 1999

[54] REDUCED SKIN FRICTION DRIVEN PILE

[75] Inventors: Frankie A. R. Queen, Lawrenceville; Jimmy D. Sailors, Norcross, both of Ga.

[73] Assignee: Foundation Technologies, Inc., Tucker, Ga.

[21] Appl. No.: 08/982,854

[22] Filed: Dec. 2, 1997

Related U.S. Application Data

[60] Provisional application No. 60/032,192, Dec. 2, 1996.

[51] Int. Cl.[6] ..... E02D 7/00; E02D 5/10

[52] U.S. Cl. ..... 405/232; 405/231; 405/256; 405/274

[58] Field of Search ..... 405/231, 232, 405/234, 242, 256, 257

[56] References Cited

U.S. PATENT DOCUMENTS

| | | | |
|---|---|---|---|
| 2,706,498 | 4/1955 | Upson | 405/256 X |
| 3,352,120 | 11/1967 | Pelzer | 405/256 X |
| 3,963,056 | 6/1976 | Shibuya et al. | 405/256 X |
| 4,119,511 | 10/1978 | Christenson | 405/232 X |
| 4,157,287 | 6/1979 | Christenson | 405/232 X |
| 4,347,019 | 8/1982 | Metz | 405/255 |
| 4,721,418 | 1/1988 | Queen | 405/231 |
| 4,818,148 | 4/1989 | Takeda et al. | 405/231 X |
| 5,145,284 | 9/1992 | Hulett et al. | 405/231 X |
| 5,763,047 | 6/1998 | Green | 405/274 X |

OTHER PUBLICATIONS

Proceedings International Conference on Design and Construction of Deep Foundations, vol. II, Sessions 1 through 4, Dec., 1994.

*Primary Examiner*—Dennis L. Taylor

*Attorney, Agent, or Firm*—Thomas, Kayden, Horstemeyer & Risley

[57] ABSTRACT

A reduced skin friction driven pile which reduces the downward frictional force applied to the pile by the settling of compressible soils surrounding the pile after the pile is driven, comprising a pile which may include a friction reduction coating located about a portion of the exterior of the pile which is expected to have soils settling relative to it. Additionally, a friction reduction collar may be placed at a location along the pile which will create a void between the soil and the portion of the pile above the collar when the pile is driven, so that soils may settle relative to the pile with the void providing reduced contact between the settling soils and the pile so that the downward force of settling soils is reduced.

16 Claims, 4 Drawing Sheets

REDUCED SKIN FRICTION DRIVEN PILE

RELATED APPLICATIONS

This application claims the benefit of U.S. Provisional Application Serial No. 60/032,192, filed on Dec. 2, 1996.

FIELD OF THE INVENTION

The present invention relates generally to foundation piles which are driven through compressible soils to support bridges and other structures. More specifically, the present invention relates to a reduced skin friction driven pile which minimizes the downward frictional force (down drag) applied to the pile by the settling of compressible soils surrounding the pile after the pile has been driven.

DESCRIPTION OF THE PRIOR ART

Deep foundations are utilized to support structures such as buildings and bridges where near surface in-place soils do not have adequate strength to support the anticipated structural loads. Various deep foundation type supports are available including driven piles, auger cast piles, drilled piers and others. The present invention, however, relates to driven piles which comprise concrete or steel structural members. These piles are relatively long, slender structural members which have a variety of cross sectional shapes including round, hexagonal or square concrete lengths, round steel pipe-piles and structural steel members such as H-pile sections. These piles are driven through soft compressible soils into hard underlying soils, partially weathered rock or rock. The support of the piles is provided by these underlying hard materials.

After a pile has been driven into the soil and becomes supported by the hard underlying materials, soft compressible surface soils adjacent the pile tend to settle or compress under overlying loads which result in a downward movement of the near surface soils relative to the pile. Compression of soft soils resulting in a downward movement of near surface soils is particularly a problem where fill materials are placed over low lying alluvial soils such as during the construction of bridge abutments. This downward movement results in a downward frictional force on the piles which is a function of the horizontal stress applied to the pile by the soil and the coefficient of friction of the pile's exterior surface relative to the soil. This downward force can result in failure of the supported structures due to an unexpected downward movement of the piles.

For many years, departments of transportation, structural engineers and geotechnical engineers have struggled with the problem of how to reduce downward frictional forces imposed upon piles by settling soils. Many costly measures have been implemented to address this problem including: delaying construction to allow underlying soils to consolidate; utilizing piles designed for an increased load capacity; pre-drilling through soils and refilling the drilled hole with a lubricating material or pea gravel; and driving a steel casing in the soils, augering out the casing and placing the pile within the casing.

When construction is delayed to allow the underlying soft soils to consolidate under the weight of newly placed fill, the delay of the construction process can last a few weeks to a few months or longer, depending on the soil. During this period, settlement of the newly placed fill is monitored until the settlement rate has decreased to a point that future settlement will not result in an excessive downward frictional force on the piles. The piles are then installed without consideration for the downward friction force as part of the pile design. This method results in considerable increased cost due to time delays in construction.

In those cases in which the anticipated structural load on the piles is increased to account for the downward frictional force anticipated, this results in a higher capacity pile which requires driving the pile further into the hard consistency soils, thereby requiring an increase in pile length and a pile driving hammer capable of driving a pile to a higher criteria. In some cases, these requirements increase the cost of pile driving and the length of time for pile installation and may require an increased cross sectional area of the pile to allow for the higher capacity.

It is also known to pre-drill holes through the soils anticipated to settle relative to the piles and refill the holes with a relatively slick material such as a polymer or a bentonite which reduces the friction between the settling soils and the pile. The pile is then driven through the pre-drilled and refilled hole into the underlying hard materials. This method adds an additional step to the construction process which results in increased site disturbance and increased construction time. This method also incurs the additional costs of the materials used as lubricant backfill, pre-drilling the holes, and disposing of the soil generated during pre-drilling. The use of a lubricant and the disposal of soil also creates environmental concerns that must be addressed during construction.

It is also known, especially in the western United States, to pre-drill holes at the pile locations and refill them with pea gravel prior to pile driving. This technique attempts to reduce adhesion of soils bearing against the piles during downward movement of near surface soils. This method is also costly due to the increased construction time and site disturbance as mentioned above. Increased costs are also generated due to disposal of soil created by pre-drilling and purchase of pea gravel utilized as backfill. This technique may also create environmental concerns as previously discussed.

Another method utilizes a steel casing which is driven through the soils anticipated to settle relative to the pile. The soils inside the casing are then removed by augering and the pile is placed inside of the casing and driven. This method adds yet another step to the construction process. In addition to the added time and site disturbance mentioned above, this method also adds the cost for the steel casing as well as the cost for handling and driving the casing. Extra cost is also incurred during the removal of the soils inside the casing and disposal of these soils.

Also, U.S. Pat. No. 4,721,418 teaches the concept of wrapping the protruding portion of a driven pile in a post-driven state with a jacket of corrugated sheet material before back fill soil is filled in about the pile. However, the jacket does not reach beneath the surface of any loose soil that might already be present about the driven pile and therefore does not function to avoid the downward settling of this loose soil. The sheet material is applied to the pile only after the pile has been driven.

The above mentioned methodologies are some of the techniques utilized to combat the downward frictional forces applied to the piles. The techniques that are utilized will vary according to the soil conditions at the site and the experience of designers and contractors in that area. All of the techniques currently being utilized are costly and time consuming.

The reduced skin friction driven pile of the present invention is an inexpensive an adaptable design solution to these prior art difficulties.

SUMMARY OF THE INVENTION

Briefly described, the present invention relates to a reduced skin friction driven pile which reduces the downward frictional force applied to the pile by the settling of compressible soils surrounding the pile after the pile has been driven into the soil and methods for its use.

Usually, soil testing is performed at the construction site to determine the depth of the compressible soils which are above the hard underlying soils. It is important that the portion of the pile to be driven into the hard underlying soil is not coated with a friction reducing material so that the friction between the exterior surface of the pile and the hard soil will support the pile in the soil.

One embodiment of the present invention is a pile which includes a friction reduction coating (FRC) applied about the portion of the exterior of the pile which is to be positioned above the hard underlying soil and is expected to have soils settling relative to it. This pile is applicable for use in all known soil conditions. Another embodiment of this pile is a friction reduction collar (collar) placed at a location along the pile which will be above the hard underlying soil and will create in a gap between the soft soil and the portion of the pile above the collar when the pile is driven downwardly into the earth so that soft soils can settle relative to the pile with reduced contact between the settling soils and the pile. This option can be used in those cases where the soils settling relative to the pile are stiff enough and cohesive enough to maintain an annular void space above the collar around the pile after the pile has been driven through the soil.

The FRC is applied to the exterior of the pile either at its point of manufacture or at the pile driving location prior to pile driving. The FRC comprises a material that has a very low coefficient of friction relative to the soils as the near surface soils settle relative to the pile. This lower coefficient of friction reduces the downward frictional force imposed on the pile by the settling soils. The FRC also has a high bond strength to the pile and is hard enough to resist being scraped off of the pile during pile driving.

The collar which may be used with or without the FRC can be installed either at the point of manufacture or, in the case of steel pipe or H-pile structural members, at the driving location. The collar would be installed on the pile at a location on the pile which, when the pile has been driven, will be near the bottom of the portion of soils expected to settle relative to the pile. This option is used where soils expected to settle relative to the pile have sufficient cohesion and strength to at least partially maintain a void space between the soil and the pile. This void space is created by the portion of the pile containing the collar, that portion being greater in outside dimensions than the remainder of the pile. As the soils settle relative to the pile they are no longer in direct contact with the pile for the piles full exterior surface area which will eliminate or greatly reduce the downward frictional force.

With the forgoing disadvantages of the prior art in mind, it is an object of the present invention to provide a negative skin friction reducing driven pile which avoids the transmission of downward settling forces applied by the settling soils surrounding a driven pile.

It is another object of the present invention to provide an improved means of protecting a pile from downward soil settling forces that provides considerable cost and time savings over prior art methods.

It is yet another object of the present invention to provide a pile which is applicable for use with variable soil characteristic considerations.

Other objects, features and advantages of the present invention will become apparent upon reading the following specification, when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. The components in the drawings are not necessarily to scale, emphasis instead being placed upon clearly illustrating principles of the present invention. In the drawings appended hereto, like numerals illustrate like parts throughout the several views.

DETAILED DESCRIPTION OF THE PREFERRED EMBODIMENTS

Figure 1A:
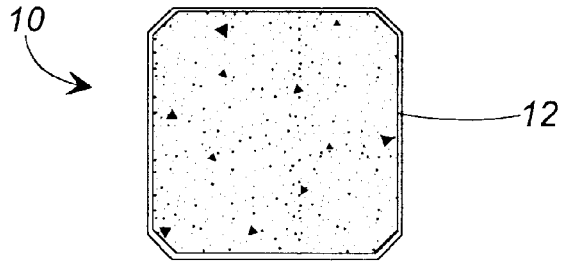
FIGS. 1A, B and C illustrate cross sectional views of reduced skin friction driven piles with a friction reduction coating applied.

Reference will now be made in detail to the description of the invention as illustrated in the drawings. While the invention will be described in connection with these drawings, there is no intent to limit it to the embodiment or embodiments disclosed therein. On the contrary, the intent is to cover all alternatives, modifications and equivalents included within the spirit and scope of the invention as defined by the appended claims.

Figure 1B:
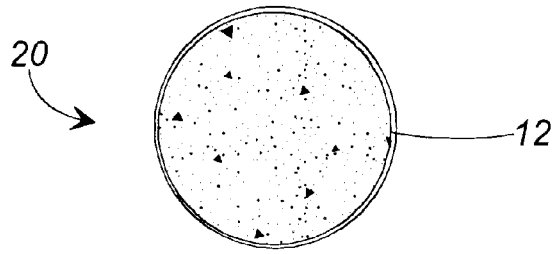
Figure 1C:
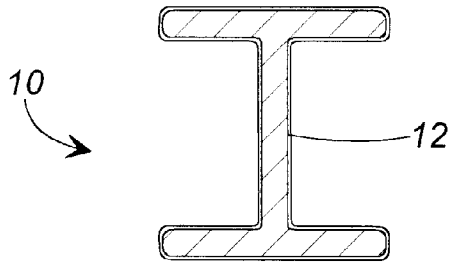

FIGS. 1A, B and C illustrate cross sectional views of different types of piles 10 with a friction reduction coating 12 applied to exterior surfaces 14. A square concrete pile is shown in FIG. 1A and a circular steel shell pile filled with concrete is shown in FIG. 1B, while the H-pile, FIG. 1C, depicts a steel pile. The friction reduction coating 12 is a compound such as an epoxy, polymer, urethane, or copolymer, possessing sufficient strength and abrasion resistance to withstand the abrasion forces applied to the pile 10 during driving operations. The coating 12 is applied at either the point of manufacture or the construction site. The coating 12 also has a very low coefficient of friction relative to the surrounding soils.

Figure 2:
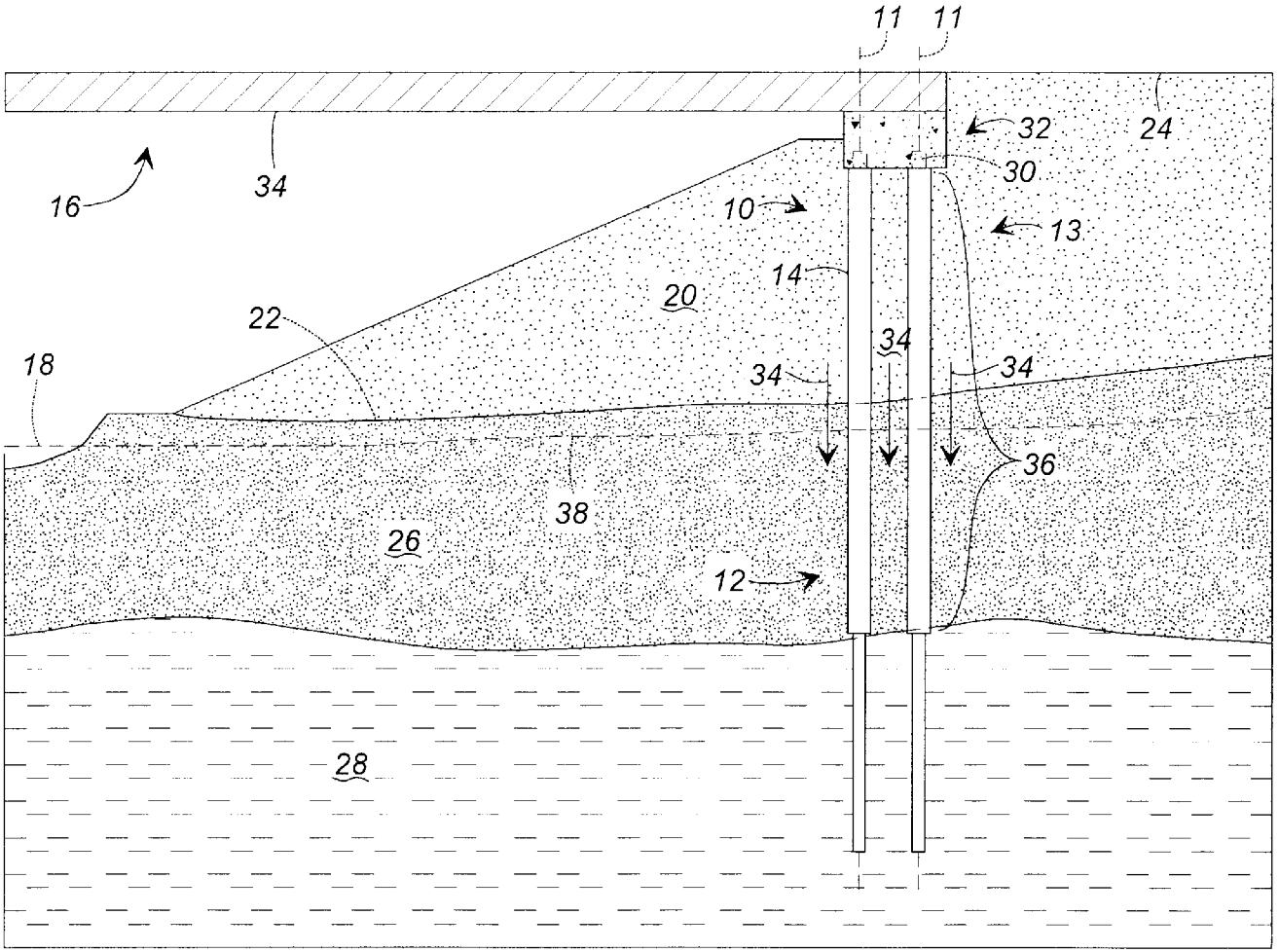
FIG. 2 illustrates a side elevation of the present invention incorporating a friction reduction coating driven through compacted fill and soft compressive soil into relatively hard soil which support a bridge deck.

FIG. 2 illustrates a side elevation of a typical bridge 16 constructed to cross a stream 18 supported by piles 10. At such locations, compacted fill 20 is placed to bring the pre-construction ground surface 22 to the proposed pavement level 24. The compacted fill 20 is placed over the existing soils which, in many cases, at stream crossings include both soft compressible soils 26 and hard soils 28 therebelow. The piles 10, each possessing a longitudinal axis 11, are driven through the compacted fill 20 and soft compressible soil 26 into relatively hard soil 28 below while the piles 10 are maintained in a substantially vertical upright orientation 13. When the piles 10 are driven to a sufficient depth within the hard soil 28 to support the stress of the proposed bridge 16, the upper portions 30 of the piles 10 are prepared and attached to a pile cap 32. Pile cap 32 supports bridge deck 34 which establishes the proposed pavement level 24.

When the compacted fill 20 is added to reach the proposed pavement level 24 the compacted fill 20 applies stress to the underlying soft soil 26 and the underlying relatively hard soil 28. The relatively hard soil is able to support this stress without compressing significantly. The soft soil 26, however, compresses under the newly applied stress which causes the compacted fill 20 and the soft compressible soil 26 to settle relative to the pile 10 which is supported by the relatively hard soils 28 below. This results in a downward movement of the compacted fill 20 and soft compressible soil 26 relative to the pile 10. Moving soils 20 and 26 which are in physical contact with the pile 10 apply a downward force 34 to the pile 10. The friction reduction coating 12 has a low coefficient of friction relative to the pile 10 which greatly reduces the downward force 34 caused by these moving or settling soils.

The friction reduction coating 12, which is a compound such as an epoxy, polymer, urethane, or copolymer, is strong enough to prevent being scraped off or altered significantly during pile driving. The coating 12 need only be applied to a soft soil contact portion 36 of the pile 10 which is expected to have soils settling relative the portion 36 after the pile 10 has been driven. The soft soil contact portion 36 is determined by measuring the depth of the soft compressible soils 26 at the location for pile 10 placement by soil testing by known methods. Once the depth is determined, the pile 10 is marked at a length which will correspond to the bottom of the soft soils 26 such that when the pile is driven, the mark substantially aligns with the bottom of the soft soils 26. Starting at this mark and measuring a distance corresponding to the soft soil depth toward the top of the pile 10, a second mark is placed on the pile 10. The area between these two marks represents the soft soil contact portion 36 of the pile. As shown in FIG. 2, the coating 12 also extends through a portion of the soils where the ground water table 38 fluctuates.

This soft soil contact portion 36 of the pile 10 would normally be subject to corrosion. The friction reduction coating 12, however, in addition to reducing the downward frictional force 34 due to soils settling relative to the pile 10, protects steel piles against corrosion by providing an additional physical moisture barrier between the ground water and the steel pile.

Figure 3:
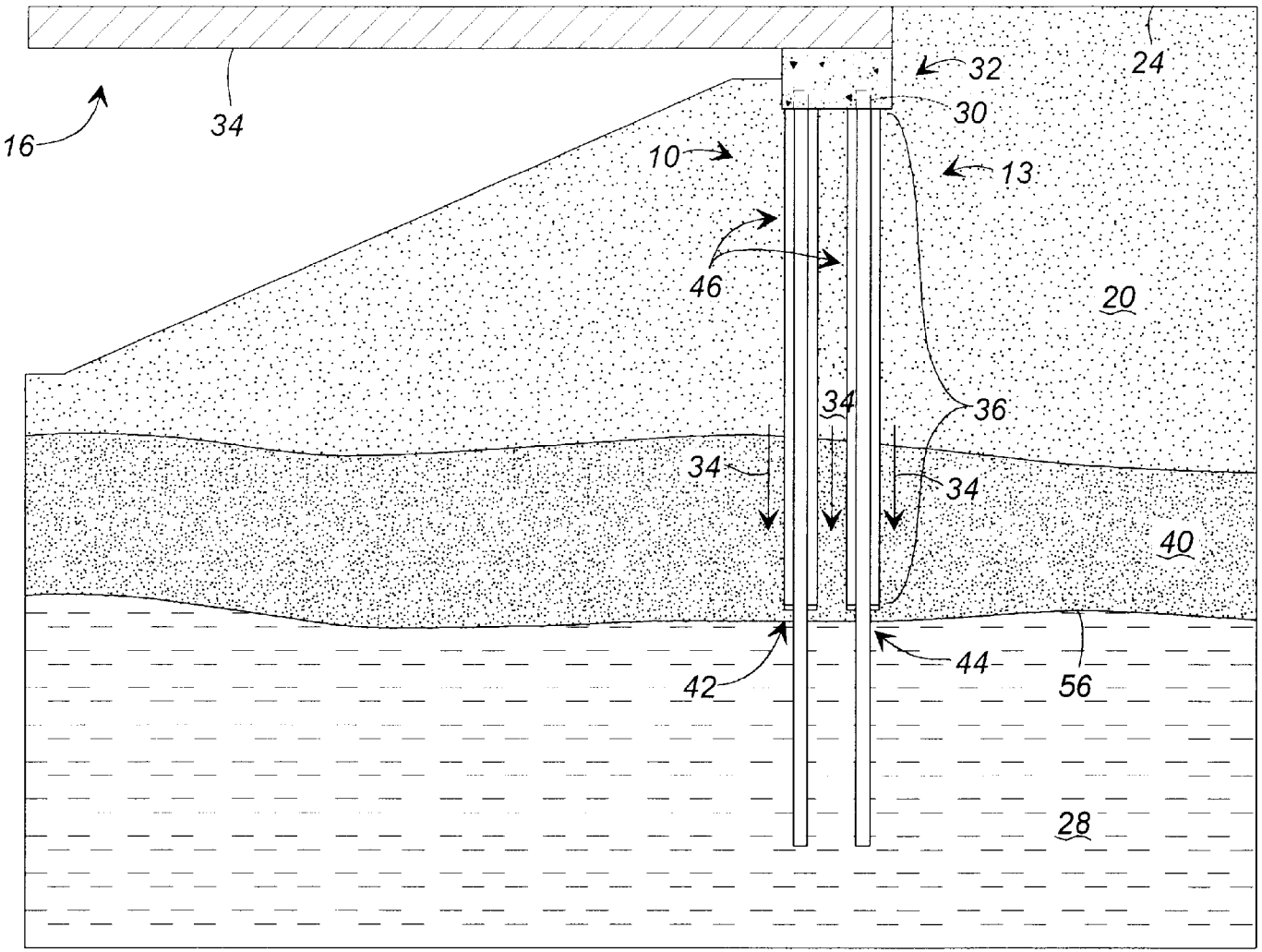
FIG. 3 illustrates a side elevation of the present invention incorporating a friction reduction collar.

FIG. 3 illustrates a side elevation of a bridge 16 for a roadway supported by piles 10. As shown, compacted fill 20 is placed over soft, cohesive clay soils 40 which overlay relatively hard soils 28. When the compacted fill 20 is placed over the soft clay soils 40, the clay soils 40 are compressed due to the stress applied by the compacted fill 20 which results in settlement of the compacted fill 20 in the soft clay soils 40 over a period of time. The relatively hard underlying soils 28, however, are relatively incompressible and do not settle relative to the pile 10. As shown in FIG. 3, the bridge piles 10 incorporate friction reduction collars 42 attached to the piles 10 near the bottom of the soft clay soils 40 before the piles 10 are driven.

A friction reduction collar 42 has a larger outside diameter 44 than the remainder of the pile 10 on which it is attached so that when the pile 10 is driven, the collar 42 creates a void 46 between the pile 10 and the compacted fill 20 soft cohesive clay soils 40 through which the collar 42 is driven. The void 46 reduces the contact between the soils 20 and 40 and the pile 10 for the portion of those soils 20 and 40 above the collar 42, which are expected to settle relative to the pile 10. This reduced contact between the soils 20 and 40 and the pile 10 reduces the downward frictional force 34 on the piles caused by settlement of the soils. The collar 42 may be welded to the exterior 14 of steel piles at either the point of manufacture or the job site and may be constructed as part of the pile 10 at the point of manufacture for concrete piles.

In a preferred embodiment, a collar segment 48 is adapted to conform to the exterior 14 of a pile 10. A plurality of segments 48 are attached to the exterior of pile 10 in a planar arrangement so that the segments attach to the pile 10 near the bottom of the soft soils 26 surrounding the pile 10 after the pile 10 has been driven. This technique is described below in relation to a concrete pile, however, this concept may be incorporated for use with any pile shape or composition.

Figure 4A:
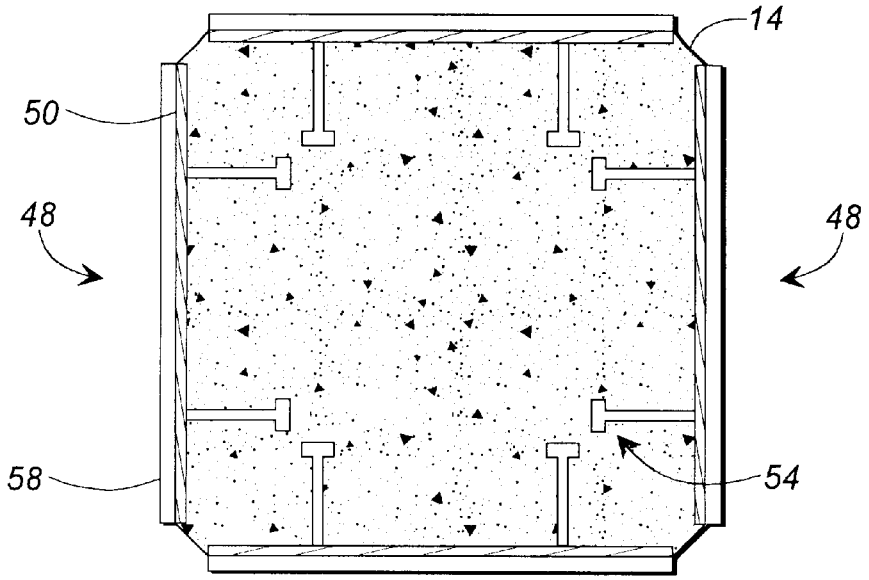
FIGS. 4A and B illustrate a plan view and a side view, respectively, of a pre-stressed concrete pile incorporating a segmented friction reduction collar.
Figure 4B:
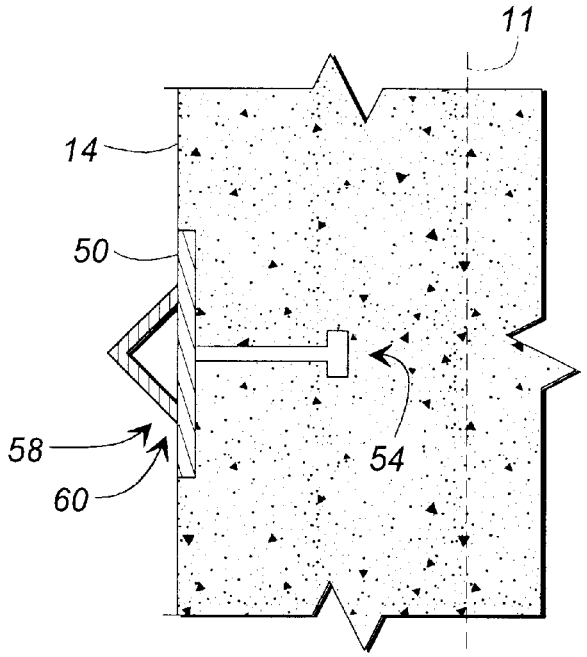

FIGS. 4A and B illustrate a plan view and a side view, respectively, of a segmented friction reduction collar 42 attached to a pre-stressed concrete pile. The segment 48 is installed as the pre-stressed concrete pile 10 is manufactured by placing wide, thick weld plates 50 inside of the concrete forms, not shown, prior to concrete placement during the manufacture of the pile 10. The weld plates 50 have studs 54 welded to the plate 50 every eight inches with a minimum of two studs 54 per plate 50. The weld plates 50 are installed at a point on the pile 10 anticipated to coincide with the bottom 56 of the soft soil 40 at the job site once the pile 10 has been installed. Once the concrete of the pile 10 has properly cured and the concrete forms have been stripped from the pile 10, structural angles 58 are welded against the weld plate 50 with fillet welds 60, as shown in FIG. 4B.

In a alternative embodiment of the present invention, a pile 10 may include both a friction reduction coating 12 and at least one friction reduction collar 42. In this manner, the downward force 34 of settling soils that would tend to refill a void 46 created by a collar 42 will be reduced by the friction reducing characteristics of the coating 12 present on the exterior 14 of the pile 10.

The foregoing description has been presented for purposes of illustration and description. It is not intended to be exhaustive or to limit the invention to the precise forms disclosed. Obvious modifications or variations are possible in light of the above teachings. The embodiment or embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

What is claimed is:

1. A reduced skin friction driven pile for application in soils having hard soil and soft soil more compressible than said hard soil disposed above the hard soil, and where said pile is configured to extend downwardly through the soft soil into the hard soil, said pile comprising:

a pile having a longitudinal axis, a first predetermined length corresponding to the depth the pile is to be extended into a hard soil for extending into a hard soil and a second predetermined length corresponding to the depth the pile is to extend into a soft soil for extending into a soft soil and an exterior surface extending along both said first and second lengths of said pile such that said exterior surface and the adjacent soils into which said pile is disposed define coefficients of friction; and a friction reduction coating adheringly engaging said exterior surface of said pile along said second predetermined length such that said friction reduction coating contacts a soft compressible soil into which said pile is to be disposed and decreases the coefficient of friction between said second predetermined length of said pile and a soft soil;

thereby reducing the effect of the soft soil settling downwardly about the pile without changing the coefficient of friction between the first length of the pile and the hard soil.

2. The pile of claim 1 wherein the friction reduction coating conforms to the exterior surface of said pile.

3. The pile of claim 1 wherein said pile is further defined as comprising a friction reduction collar fixedly engaging said pile, said friction reduction collar adapted and arranged to form a void between said pile and said soft compressible soil while said pile is driven into said soils, whereby said void reduces contact between said soft compressible soil and said exterior surface of said pile.

4. The pile of claim 2 and wherein the exterior surface of said pile is formed of steel and said friction reduction coating is a corrosion inhibitor.

5. A reduced skin friction driven pile for driving into soils having a hard soil and a soft more compressible soil disposed above a hard soil, comprising:

a pile having a longitudinal axis and an exterior surface such that said exterior surface and the soils into which said pile is driven define a coefficient of friction;

a friction reduction collar fixedly engaging said pile, said friction reduction collar adapted and arranged to form a void between said pile and a soft soil while said pile is driven into the soils, whereby said void reduces contact between a soft soil and said exterior surface of said pile; and a friction reduction coating disposed on a portion of said exterior surface of said pile, said coating being in contact with a soft soil after said pile is driven into a soft compressible soil and a hard soil;

wherein the coefficient of friction is decreased between the pile and a soft soil adjacent the pile subsequent to the pile being driven, thereby reducing the effect of settling soft soil and the coefficient of friction is unchanged between the pile and a hard soil.

6. The pile of claim 5 wherein the friction reduction collar is further defined as comprising a configuration which creates a void in a soft soil surrounding said pile by displacing a soft compressible soil radially outwardly from said longitudinal axis of said pile as said pile is driven into the soils thereby creating the outer periphery of said void such that said void reduces the coefficient of friction between soft soil and said exterior surface of said pile.

7. The pile of claim 5 wherein the friction reduction collar is further defined as comprising an angled portion extending outwardly and upwardly from said exterior surface such that when said pile is in a vertical upright orientation said angled portion and said longitudinal axis form an angle of less than 90.

8. The pile of claim 5 wherein the friction reduction collar is further defined as comprising a plurality of collar segments arranged in a substantially planar arrangement about said exterior surface.

9. A method of reducing skin friction on a driven pile for application in soils having a hard soil and a more compressible soft soil layer disposed above a hard soil layer comprising the steps of:

providing a pile having a predetermined length;

determining a depth to which said pile will be disposed into the soils and determining the portion of the pile to contact a soft compressible soil;

applying a friction reduction coating to the external surface of said portion of said pile to contact said soft compressible soil; and driving said pile into the soils.

10. A method according to claim 9 wherein the step of applying the friction reduction coating is further defined as applying a coating that conforms to the exterior surface of said pile.

11. The method of claim 9 and wherein the step of applying a friction reduction coating comprises applying a coating of corrosion inhibitor.

12. A method according to claim 9 further comprising the step of: providing a friction reduction collar which fixedly engages said pile at said portion of said pile to contact a soft compressible soil, said friction reduction collar adapted and arranged to form a void between said pile and a soft compressible soil while said pile is driven into the soils, whereby said void reduces contact between a soft compressible soil and said exterior surface of said pile.

13. A method for reducing skin friction on a driven pile for application in soils having a hard soil and a more compressible soft soil layer disposed above a hard soil layer comprising the steps of:

determining the depth of a hard layer of soil below the surface of the ground;

providing a pile having a longitudinal axis;

providing a friction reduction collar which fixedly engages a portion of said pile to be adjacent a soft soil; and driving said pile into the soils;

wherein the pile is driven into a soil such that the collar forms a void between said pile and a soft soil while said pile is driven into the soils, and said void reduces contact between a soft soil and said exterior surface of said pile.

14. A method according to claim 13 wherein the step of providing a friction reduction collar is further defined as providing a collar which creates a void in a soft soil surrounding said pile by displacing a soft soil radially outwardly from said longitudinal axis of said pile as said pile is driven into the soils, thereby creating the outer periphery of said void such that said void reduces the coefficient of friction between a soft soil and said exterior surface of said pile.

15. A method according to claim 13 wherein the friction reduction collar is further defined as comprising an angled portion extending outwardly and upwardly from said exterior surface such that when said pile is in a vertical upright orientation said angled portion and said longitudinal axis form an angle of less than 90.

16. A method according to claim 14 wherein the friction reduction collar is further defined as comprising a plurality of collar segments arranged in a substantially planar arrangement about said exterior surface.

* * * * *